US007147130B1

(12) United States Patent
Clark et al.

(10) Patent No.: US 7,147,130 B1
(45) Date of Patent: Dec. 12, 2006

(54) SINGLE DOSE PILL DISPENSING SYSTEM

(76) Inventors: Noel Clark, 10511 Saint Rose Ct., Riverview, FL (US) 33569; Preston Beck, 2705 Alta View Dr., Birmingham, AL (US) 35243

( * ) Notice: Subject to any disclaimer, the term of this patent is extended or adjusted under 35 U.S.C. 154(b) by 0 days.

(21) Appl. No.: 11/122,897

(22) Filed: May 6, 2005

(51) Int. Cl.

| | |
|---|---|
| ***G07F 11/00*** | (2006.01) |
| ***G07F 11/72*** | (2006.01) |
| ***A24F 27/14*** | (2006.01) |
| ***B65D 83/00*** | (2006.01) |

(52) U.S. Cl. ..... 221/288; 221/147

(58) Field of Classification Search ..... 221/189, 221/186, 193, 288, 222, 543; 206/538, 540; 222/543

See application file for complete search history.

(56) References Cited

U.S. PATENT DOCUMENTS

| | | | | | |
|---|---|---|---|---|---|
| 2,211,120 | A | * | 8/1940 | Holland | 141/322 |
| 3,079,043 | A | * | 2/1963 | Le Blanc et al. | 221/265 |
| 3,289,885 | A | * | 12/1966 | Villaveces | 221/288 |
| 3,620,413 | A | * | 11/1971 | Borsum | 221/289 |
| 3,622,041 | A | * | 11/1971 | Borsum et al. | 221/202 |
| 3,833,147 | A | * | 9/1974 | Borsum et al. | 221/202 |
| 3,874,564 | A | * | 4/1975 | Huneke | 222/363 |
| 3,991,908 | A | * | 11/1976 | Thomas et al. | 221/154 |
| 4,273,254 | A | * | 6/1981 | Cuppleditch et al. | 221/196 |
| 4,420,076 | A | * | 12/1983 | Beveridge et al. | 206/37 |
| 4,454,962 | A | * | 6/1984 | Greenspan | 221/288 |
| 4,522,313 | A | * | 6/1985 | Jennings et al. | 221/1 |
| 4,523,694 | A | * | 6/1985 | Veltri | 221/265 |
| 4,530,447 | A | * | 7/1985 | Greenspan | 221/288 |
| 4,648,529 | A | * | 3/1987 | Blakemore et al. | 221/1 |
| 4,653,668 | A | * | 3/1987 | Gibilisco et al. | 221/298 |
| 4,744,492 | A | * | 5/1988 | Hackmann et al. | 221/204 |
| 4,765,459 | A | * | 8/1988 | Edwards | 206/38.1 |
| 4,828,143 | A | * | 5/1989 | Jennings | 221/266 |
| 4,887,738 | A | * | 12/1989 | Jennings et al. | 221/264 |
| 5,018,644 | A | * | 5/1991 | Hackmann et al. | 221/65 |
| 5,108,006 | A | * | 4/1992 | Tieke et al. | 221/152 |
| 5,255,786 | A | * | 10/1993 | McQuay | 206/534.2 |
| 5,791,515 | A | | 8/1998 | Khan et al. | |
| 5,850,944 | A | * | 12/1998 | Robbins et al. | 222/158 |
| 5,897,025 | A | * | 4/1999 | Flewitt et al. | 221/257 |
| 6,267,265 | B1 | | 7/2001 | Issa | |
| 6,561,379 | B1 | * | 5/2003 | Goh | 221/90 |

* cited by examiner

*Primary Examiner*—Kathy Matecki
*Assistant Examiner*—Rakesh Kumar
(74) *Attorney, Agent, or Firm*—William B. Noll

(57) ABSTRACT

A single pill dispensing system for a bottle/vial of the type for dispensing a medication pill, where the bottle/vial has a circular body and receives a circular cap. To facilitate the dispensing of a single pill, an insert, slidably received in the circular body and circular cap is provided. The insert includes a body portion containing a circuitous channel of a size to accommodate a single pill as the user inverts or turns over the container body to capture and subsequently transfer the pill through the insert to a nesting recess in the lower surface of the circular cap.

5 Claims, 3 Drawing Sheets

SINGLE DOSE PILL DISPENSING SYSTEM

FIELD OF THE INVENTION

This invention is directed to the field of pill dispensing mechanisms, more particularly to a single dose pill dispensing system that features an insert for use with conventional pill bottles used by pharmacies in filling prescriptions.

BACKGROUND OF THE INVENTION

The present invention relates to a single dose pill dispensing system that meets Federal Government standards for child proof access, specifically 16 CFR 1700.15(b) and 1700.20. That is, to prevent children from opening a pill bottle/vial, a pharmacy must now use only bottles or vials that require adult effort to open. This is mandatory unless the user requests that the pharmacy not incorporate the child-proof container. One leading pharmacy uses a standard sized bottle, about 2¾" in height and 1⅛" diameter, that includes a reversibly threaded cap, with a flexible annular tab in proximity to the bottle opening, where in a protective mode, an internally threaded cap is threaded to the bottle opening. To open the closed bottle, the flexible annular tab must be depressed to free the cap and allow the user to open the bottle. However, the cap is also externally threaded on its top, and when reversed may be conventionally threaded to internal threads at the bottle opening. This allows the pharmacy to satisfy all users with the same bottle, namely reversibly securing the cap as requested by the user.

The prior art and known commercial pill dispensing systems recognize the need to protect small children, as well as satisfying adults who do not need to exert the extra effort to open the container, especially for senior adults with arthritic hands. Additionally, though not often addressed, seniors like pill dispensing systems that allow for the convenient withdrawal of a single dose at one time. Different pill dispensing systems of the prior art may be found in the following U.S. patents:

a.) U.S. Pat. No. 6,267,265, to Issa, teaches a pill dispenser to dispense a pill received from a pill container engaged there below. The pill dispenser comprises a cavity, said cavity having an exposed end and shaped to form a conical surface therein. The conical shape of the dispenser cavity, advantageously, allows pills to be engaged therein and dispensed therefrom, one at a time, regardless of the shape and size of the pills. Optionally, the pill dispenser is disposed within a cap or closure member, mountable to common containers available at most retail outlets. Further optionally, the pill dispenser is disposed within the container itself.

b.) U.S. Pat. No. 5,897,025, to Flewit et al., discloses a container for dispensing tablets in which the dispensing opening and/or a dispensing passage upstream of the dispensing opening is constricted such that a tablet is releasably retained with part of the tablet projecting outside of the dispensing opening. The part of the rim of the dispensing opening or an adjacent part of the container is movable relative to the rest of the container so as to facilitate the release of the retained tablet from the container.

c.) U.S. Pat. No. 5,791,515, to Khan et al., relates to a one-at-a-time pill container and dispenser having a mechanism which allows for use of the device with existing containers. A child-proof lock is provided. The device has a mechanism for ensuring that only a single pill is brought into the dispensing chamber as a consequence of a partial rotation of the cap with respect to the bottle body, a reverse partial rotation of the cap then allows the pill to fall by gravity into the user's hand. The two-directional rotation to cause pill dispensing is easy for an adult but highly unlikely to be accidentally duplicated by a child. The mechanism is a series of wedge shaped chambers, sized for the capsule to be dispensed, with a covering flange over the dispensing chamber, to ensure that only a single capsule enters the dispensing aperture. The chambers are caused to be rotated by the mating engagement of the cap, via a pawl, with a segment shaped slot in the top of the dispensing mechanism.

d.) U.S. Pat. No. 4,887,738, to Jennings et al., covers an article dispenser especially advantageous for dispensing pills of the prescription drug or over-the-counter type, comprises three components including a container member, a dispenser control member and a flexible member. The container member provides a dispenser portion through which the articles are passed in a serial array whereby one article reaches an exit aperture while the remaining articles are restrained at gate apertures within the dispenser portion by the flexible member and the control member. The dispenser components are preferable made of low-cost molded plastic and when assembled provide an easy access dispenser not requiring two hands for activation.

Though the prior art offers a number of interesting, even complex, solutions to providing assistance to prescription users that may want to protect children or even make it convenient to safely use a prescription container, they fail to teach an insert that may be used with existing bottles/vials. Specifically, none offer the convenience of the present invention to incorporate an insert into a conventional pill bottle to limit the dispensing of a single pill or dose. The manner by which this invention achieves the goals hereof will be made clearer in the description which follows, especially when read in conjunction with the accompanying drawings.

SUMMARY OF THE INVENTION

This invention teaches a single dose dispensing system for use with a conventional bottle/vial of the type for dispensing a medication, for example. Specifically, the innovative feature of this invention is a uniquely configured insert for snugly fitting within the cap of the bottle/vial, and which is slidably received within the body of the bottle/vial. As known in the art, a conventional bottle/vial of the type supplied by a pharmacy when filling a prescription comprises a generally circular body portion having an open end, and a container cap for securing, such as by complementary threads, to the container body. The uniquely configured insert comprises a top portion for seating against the under surface of the container cap with a downwardly extending body portion. The body portion features a radially directed segment that includes a pair of flared side edges extending from a tip toward the outer wall of the body portion. The radially directed segment is surrounded by an arcuate opening that leads to a circuitous cavity and ending at a pill nesting recess in the top portion. Further, underlying the pill nesting recess at said tip is a flat recess, characterized by an upstanding protrusion, and an angled wall extending upward from the flat recess. By this arrangement, a single pill or dose, when the container body and cap are turned or inverted, is captured within the circuitous cavity and prevented from returning to the container body by the tip protrusion.

Accordingly, a feature of this invention is a bottle/vial container system for dispensing a single pill or dose for the user thereof.

Another feature hereof is the provision of a uniquely configured insert for placement in a conventional bottle/vial of the type for containing a prescribed medication.

Still a further feature of the invention is a uniquely configured insert that includes a circuitous cavity in communication with the container body.

Another feature of this invention is an insert with a circuitous cavity that captures the single pill or dose to facilitate selection of the single said pill or dose.

These and other features of the invention will become apparent in the further description which follows, especially when read in conjunction with the following drawings.

DETAILED DESCRIPTION OF PREFERRED EMBODIMENT

Figure 1:
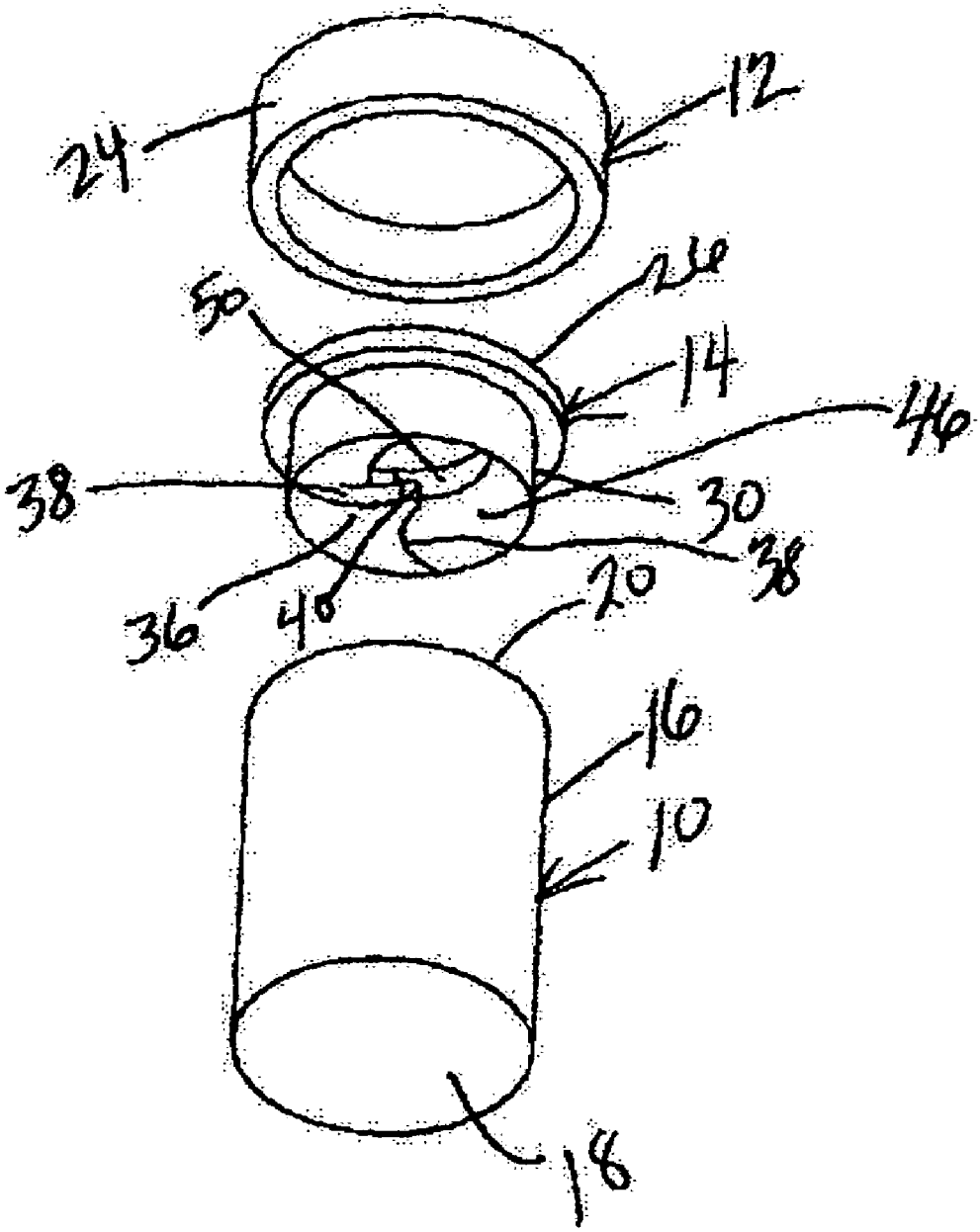
FIG. 1 is an exploded perspective view showing the pill dispensing insert for incorporation in a conventional bottle/vial, such as used with prescription drugs, with an overriding cap.

The present invention relates to a single dose medication bottle/vial, ideal for dispensing a single pill or dose. The invention preferably relates to a uniquely configured insert that may be incorporated into conventional bottle/vials used by pharmacies to fill prescriptions, especially for senior citizens. The invention will now be described with regard to the three Figures, where like reference numerals represent like components or features throughout the several views.

Turning first to FIG. 1, illustrating an exploded perspective view of a conventional bottle/vial that includes a generally cylindrical container 10 and container cap 12 for threading engagement with the cylindrical container 10. The unique insert 14 is sized to be snugly seated within the container cap 12, and for sliding engagement with the cylindrical container 10.

Before continuing with the insert 14, it will be seen that the cylindrical container comprises a circular side wall 16, a closed base 18, and an open end 20. The cylindrical container 10, in proximity to said open end 20, may be provided with internal and/or external threads for engaging the container cap 12, as known in the art. The container cap 12 comprises a top wall 22 and a downwardly extending peripheral wall 24 to overlie and engage the open end 20, again as known in the art.

Figure 2:
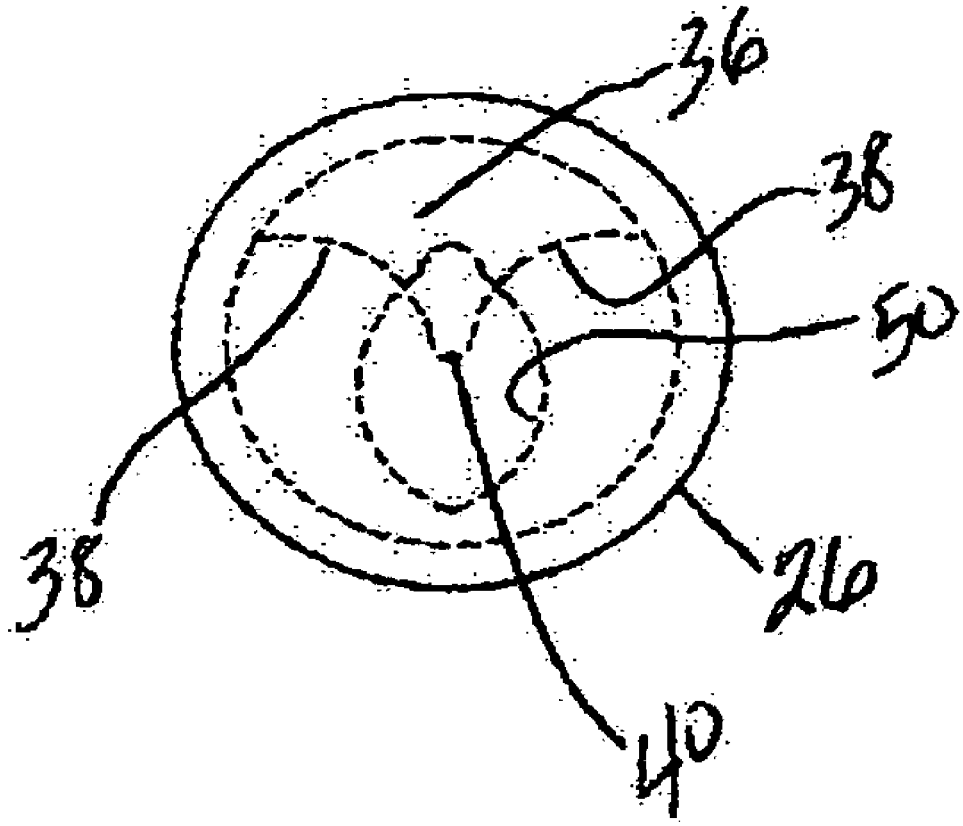
FIG. 2 is a top view of the assembled system with hidden features of the insert shown in dotted lines.
Figure 3:
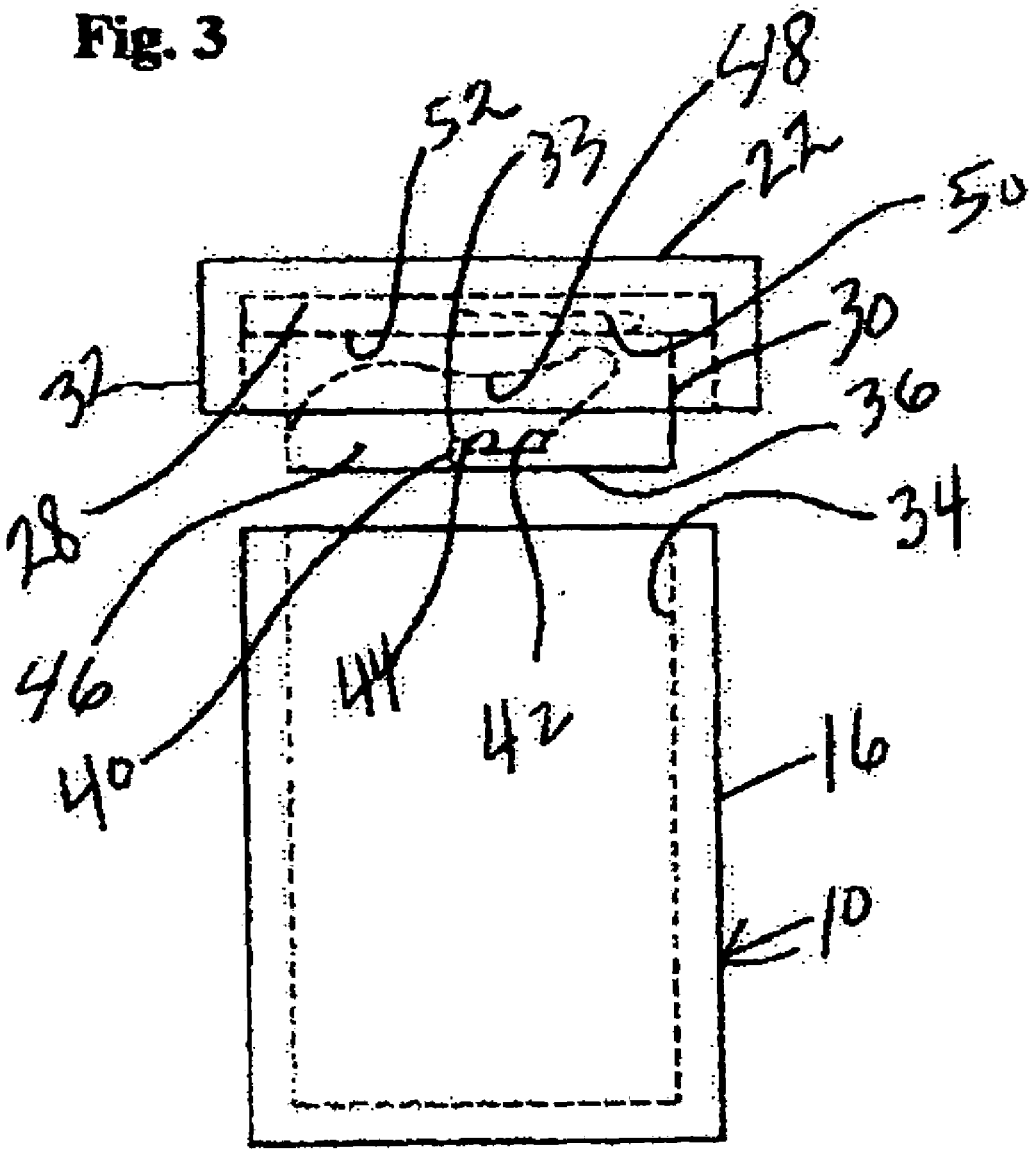
FIG. 3 is an exploded side view of the system hereof showing the insert positioned within the cap.

The insert 14, forming the essence of this invention comprises a T-shaped member composed of a top member 26 of a diametrical size to be snugly received within the container cap 12 to lie contiguous to the bottom surface 28 of said container cap 12. Extending downwardly from the top wall 22 is a circular body 30 having an exterior surface 32 sized for sliding engagement with the inner surface 34 of the circular side wall 16. Internally, the circular body 30 includes a radially extending segment 36 featuring a pair of flared sides 38 and a tip 40. As best seen in FIG. 3, the upper surface 42 includes a flat recess 44 remote from said exterior surface 32, terminating in an upstanding protrusion 33, then angles upwardly towards the top wall 22. The circular body 30 further includes an arcuate opening 46 about the radially extending segment 36, where the single pill or dose moves through said opening into the circular body 30. As seen in FIG. 3, a circuitous cavity 48 is provided to transmit the single pill or dose. Finally, in communication with the circuitous cavity 48 is a recess 50 in the lower surface 52 of the top wall 22 for nesting the selected pill or dose, where the nesting recess is offset from the tip 40, see FIG. 2. In using the bottle/vial system for selective capturing the single pill or dose, the prescription filled bottle/vial is turned or inverted whereby a selected pill or dose moves through the arcuate opening 46, along the cavity 48 into the nesting recess 50. Once settled, the bottle/vial may be opened and the selected pill or dose, temporarily prevented from returning to the bottle/vial by the protrusion 33, retrieved without having to be concerned with multiple pills or doses that have to be returned to the bottle/vial.

It is recognized that changes, modifications and variations may be made to the insert of this invention, especially by those skilled in the art, without departing from the spirit and scope thereof. Accordingly, no limitation is intended to be imposed thereon except as set forth in the accompanying claims.

We claim:

1. An insert for a bottle/vial for dispensing pills of medication, where the bottle/vial comprises an elongated, circular container body with an open end and a circular cap for threading engagement with said container body over said open end, said insert, adapted for dispensing a single said pill, comprising:

a circular body sized for sliding receipt in said circular container body and said circular cap, said circular body having a closed top surface and a bottom surface, where the bottom surface includes a nesting recess offset from the center thereof for receiving said single said pill, and a remote end featuring a partial arcuate opening in communication with and offset from said nesting recess via a circuitous channel to facilitate the dispensing of a said single pill, where said circuitous channel comprise an S-configured wall and is sized to accomodate a single said pill.

2. The insert according to claim 1, where said remote end is further characterized by a radially directed arm flaring from the edge of said circular body to a middle central tip, where said tip underlies said bottom surface recess.

3. The insert according to claim 2, where said radially directed arm includes an upper surface having a flat recess extending from said central tip then angled toward said nesting recess.

4. The insert according to claim 2, wherein said circular body is T-configured having a top section to overlie said container body and a lower section extending to said remote end and sized for sliding receipt within said container body.

5. The insert according to claim 1, wherein said container body at said open end is externally threaded to receive complementary threads on said circular cap.

* * * * *